US005644870A

United States Patent [19]

Chen

[11] Patent Number: 5,644,870

[45] Date of Patent: Jul. 8, 1997

[54] COMPRESSION MOLDED DOOR ASSEMBLY

[75] Inventor: Kuei Yung Wang Chen, Taipei, Taiwan

[73] Assignee: Nan Ya Plastics Corporation, Taipei, Taiwan

[21] Appl. No.: 490,125

[22] Filed: Jun. 14, 1995

[51] Int. Cl.[6] ..... E06B 3/00; E06B 3/96

[52] U.S. Cl. ..... 49/501; 49/503

[58] Field of Search ..... 49/501, 503; 52/784.12, 52/784.13, 784.15, 787.1, 802.1, 792.1, 792.11

[56] References Cited

U.S. PATENT DOCUMENTS

| | | | |
|---|---|---|---|
| 653,400 | 7/1900 | Rapp . | |
| 678,903 | 7/1901 | Rapp . | |
| 751,435 | 2/1904 | Ohnstrand . | |
| 956,556 | 5/1910 | Wege . | |
| 1,183,842 | 5/1916 | Alling . | |
| 1,249,814 | 12/1917 | Otte . | |
| 2,557,412 | 6/1951 | Clements . | |
| 2,849,758 | 9/1958 | Plumley et al. . | |
| 2,871,056 | 1/1959 | Levitt . | |
| 2,890,977 | 6/1959 | Bayer et al. . | |
| 2,924,861 | 2/1960 | Viets . | |
| 3,153,817 | 10/1964 | Pease, Jr. . | |
| 3,225,505 | 12/1965 | Lytz . | |
| 3,250,041 | 5/1966 | Anger . | |
| 3,299,595 | 1/1967 | Munk . | |
| 3,333,385 | 8/1967 | King | 52/784.13 X |
| 3,386,209 | 6/1968 | Starcevic | 49/501 |
| 3,402,520 | 9/1968 | Lee et al. . | |
| 3,404,502 | 10/1968 | Miller . | |
| 3,455,078 | 7/1969 | Brown et al. | 49/503 X |
| 3,498,001 | 3/1970 | MacDonald . | |
| 3,512,304 | 5/1970 | Meuret . | |
| 3,546,841 | 12/1970 | Smith et al. . | |
| 3,593,479 | 7/1971 | Hinds et al. . | |
| 3,616,116 | 10/1971 | McDonald . | |
| 3,950,894 | 4/1976 | DiMaio . | |
| 4,152,876 | 5/1979 | Seely . | |
| 4,154,034 | 5/1979 | Bursk et al. . | |
| 4,265,067 | 5/1981 | Palmer . | |
| 4,327,535 | 5/1982 | Governale . | |
| 4,344,256 | 8/1982 | King | 49/501 |
| 4,374,693 | 2/1983 | Pitt . | |
| 4,383,812 | 5/1983 | Calcagni . | |
| 4,512,124 | 4/1985 | Banford . | |
| 4,546,585 | 10/1985 | Governale . | |
| 4,550,540 | 11/1985 | Thorn . | |
| 4,635,421 | 1/1987 | Newberg . | |
| 4,720,951 | 1/1988 | Thorn et al. . | |
| 4,724,115 | 2/1988 | Freeman . | |
| 4,746,383 | 5/1988 | Bacon et al. . | |
| 4,752,517 | 6/1988 | Beitel | 49/501 X |
| 4,811,538 | 3/1989 | Lehnert et al. . | |
| 4,819,383 | 4/1989 | McKann et al. | 49/503 X |
| 4,850,144 | 7/1989 | Grisham et al. | 49/501 X |

(List continued on next page.)

FOREIGN PATENT DOCUMENTS

| | | |
|---|---|---|
| 1420244 | 1/1976 | United Kingdom . |
| 1487309 | 9/1977 | United Kingdom . |
| 2133069 | 7/1984 | United Kingdom . |

*Primary Examiner*—Kenneth J. Dorner
*Assistant Examiner*—Curtis Cohen
*Attorney, Agent, or Firm*—Finnegan, Henderson, Farabow, Garrett & Dunner, L.L.P.

[57] ABSTRACT

A door according to this invention is formed from two rectangular compression molded skins with each skin having inside surface and an outside surface and on its inside surface a plurality of projecting, parallel ribs along at least two of its edges, a hinge support having a plurality of grooves on its opposite sides with the grooves operable to interlock with the ribs of the skins along one side of the door when the skins are assembled with this support and an accessory support having a plurality of grooves on its opposite sides operable to interlock the ribs of the skins along the other side of the door when the skins are assembled therewith whereby no frame is required for the door when a foamed in place polyurethane core is formed between the skins. The door used interlocking members at its side and top edges and a preformed bottom panel or insert.

11 Claims, 5 Drawing Sheets

U.S. PATENT DOCUMENTS 4,850,168 7/1989 Thorn .
4,860,512 8/1989 Thorn .
4,864,789 9/1989 Thorn .
4,901,493 2/1990 Thorn .
4,922,674 5/1990 Thorn .
4,947,585 8/1990 Guetle, Jr. .
4,965,030 10/1990 Thorn .
4,977,705 12/1990 Guetle, Jr. .
5,074,087 12/1991 Green .
5,075,059 12/1991 Green .
5,142,835 9/1992 Mrocca .
5,161,346 11/1992 Olson et al. ..... 49/501 X
5,175,970 1/1993 Green .
5,325,648 7/1994 Ménard .

Fig. 1A
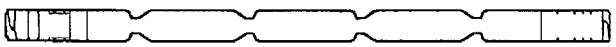
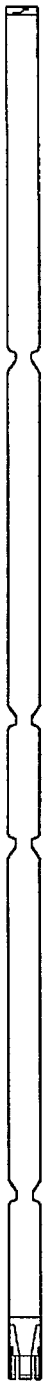
Fig. 1B
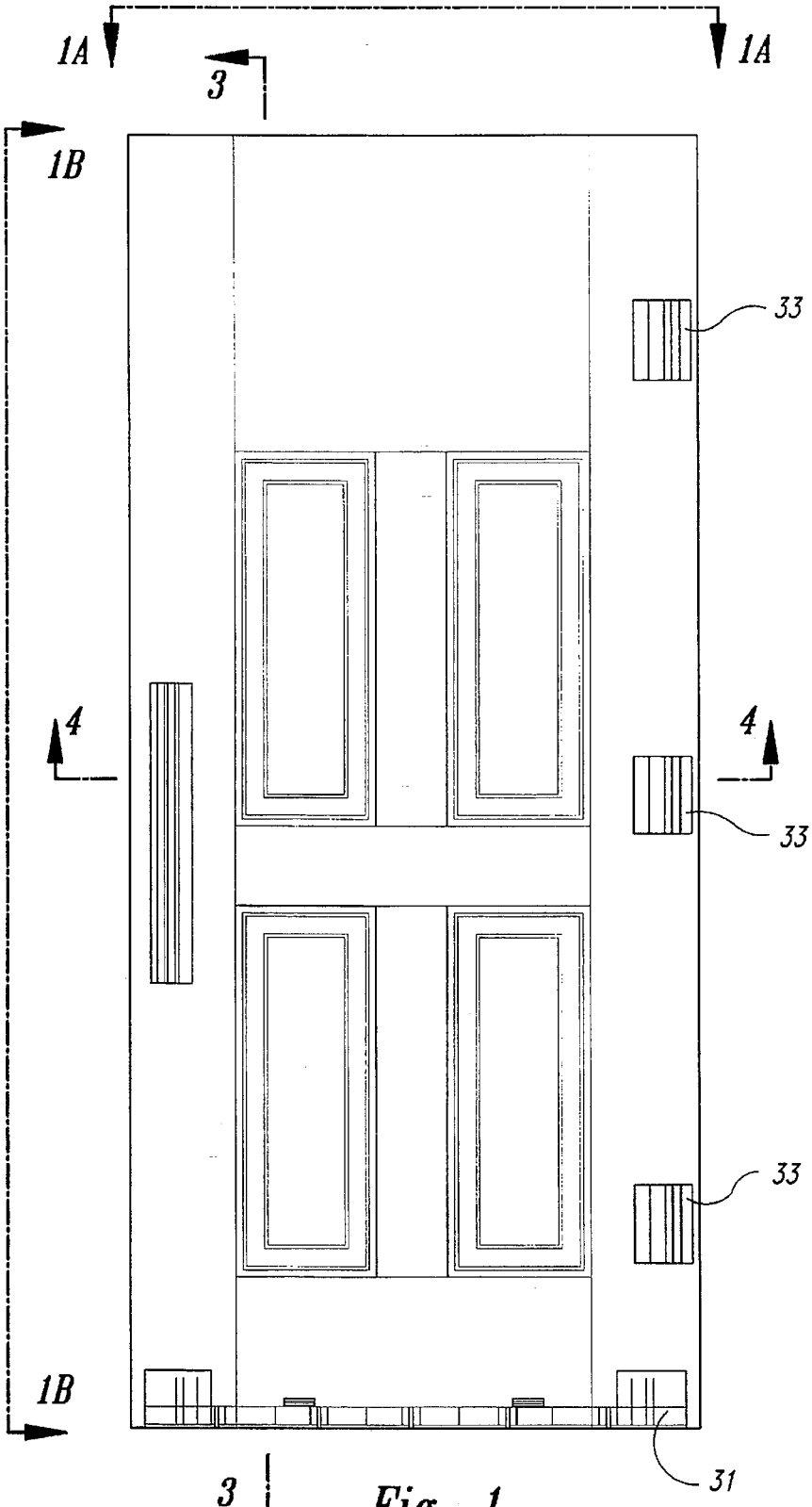
Fig. 1

COMPRESSION MOLDED DOOR ASSEMBLY

BACKGROUND

As plastic technologies improve building components previously made of natural products, such as wood, are now constructed of synthetic materials. In particular doors for home and business construction have been made of thin skins which are compression molded, complete with embossed wood grain patterns on their surfaces. Typically these skins are mounted on a frame which separates and supports the skins in a spaced apart relationship and the hollow space between the skins is then filled with a foam material, such as a polyurethane foam.

Patents relating to these types of door structures, include U.S. Pat. No. 4,901,493, U.S. Pat. No. 4,860,512, U.S. Pat. No. 4,864,789, U.S. Pat. No. 4,550,540, U.S. Pat. No. 4,965,030 all issued to Thorn, along with U.S. Pat. No. 5,142,835 issued to Mrocca and U.S. Pat. No. 5,075,059 issued to Croon.

U.S. Pat. No. 4,550,540 is typical of such door structures using a frame on which compression molded skins are assembled to form a door assembly. By contrast the current invention does not use a frame, but rather interlocks the skins with a plurality of ribs and grooves that interlock the skins together in a rigid relationship when the hollow space between is filled with foam material. The assembly forms a durable door assembly which can be constructed economically.

Also it is contemplated that the preformed insert be used at the bottom of the door assembly which can be trimmed to the proper size along with providing additional strength to the resulting assembly.

Further it is also part of the invention to use edge projection from the skins that form the outer panel of the door assembly which interlock with one another. Another feature is the use of edge molding which can be used to cover the foam core when the door assembly has been trimmed to fit a door jamb.

SUMMARY OF THE INVENTION

A door according to this invention includes a pair of preformed, rectangular skins, each skin having an outer surface and an inner surface and having a plurality of elongated ribs extending from its inner surface along the longer axis of said skin and located adjacent to its opposed edges, an elongated accessory block with a rectangular configuration with the block having a plurality of grooves on its opposed surfaces operable to receive said ribs on said skins along one edge of the door when assembled therewith, at least one hinge member with a rectangular configuration with a plurality of grooves on its opposed surfaces operable to receive said ribs on said skins on the edge of the door opposite to the accessory block, edge strips associated with the periphery of the skins closing the periphery of the door when the skins are assembled on the block and member and a foam core disposed between said skins locking the component in place.

Typically glue will be used to join the ribs in the grooves and three separate hinge members will be employed along one edge of the door. The elongated accessory block along the opposite side of the door provides the internal support for the door handle and latch units along with the ability to mount these assemblies at different heights. Along the bottom door, it is preferred to use an insert which can be trimmed so bottom of the door can be conformed to the threshold of the door frame.

DETAILED DESCRIPTION OF THE DRAWINGS

The invention will be better understood by reference to the following drawings when reading the description of the invention contained herein:

FIG. 1 is a plan view of the novel door assembly of this invention with the elongated accessory block and hinge members shown in phantom;

FIG. 1A shows a top elevation of the novel door assembly of this invention.

FIG. 1B shows a side elevation of the novel door assembly of this invention.

DETAILED DESCRIPTION OF THE PREFERRED EMBODIMENTS

The features and advantages of this invention are described in this specification in conjunction with the drawings illustrating a preferred embodiment of the invention.

Figure 4:
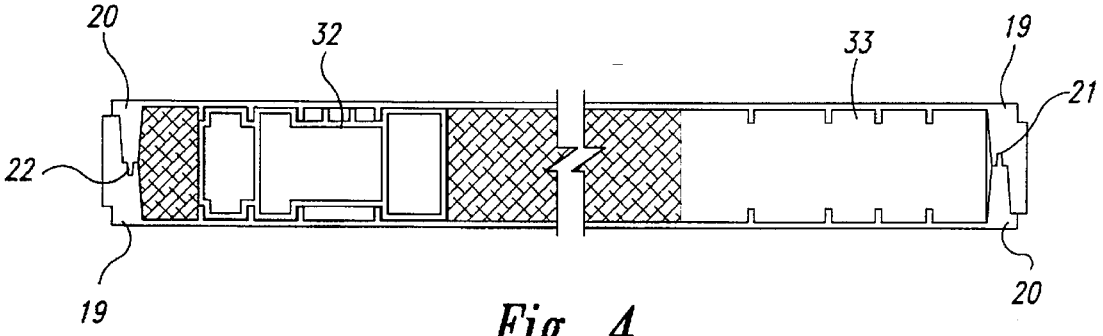
FIG. 4 is a horizontal cross-section view of door assembly of this invention along lines 4—4 of FIG. 1.
Figure 5:
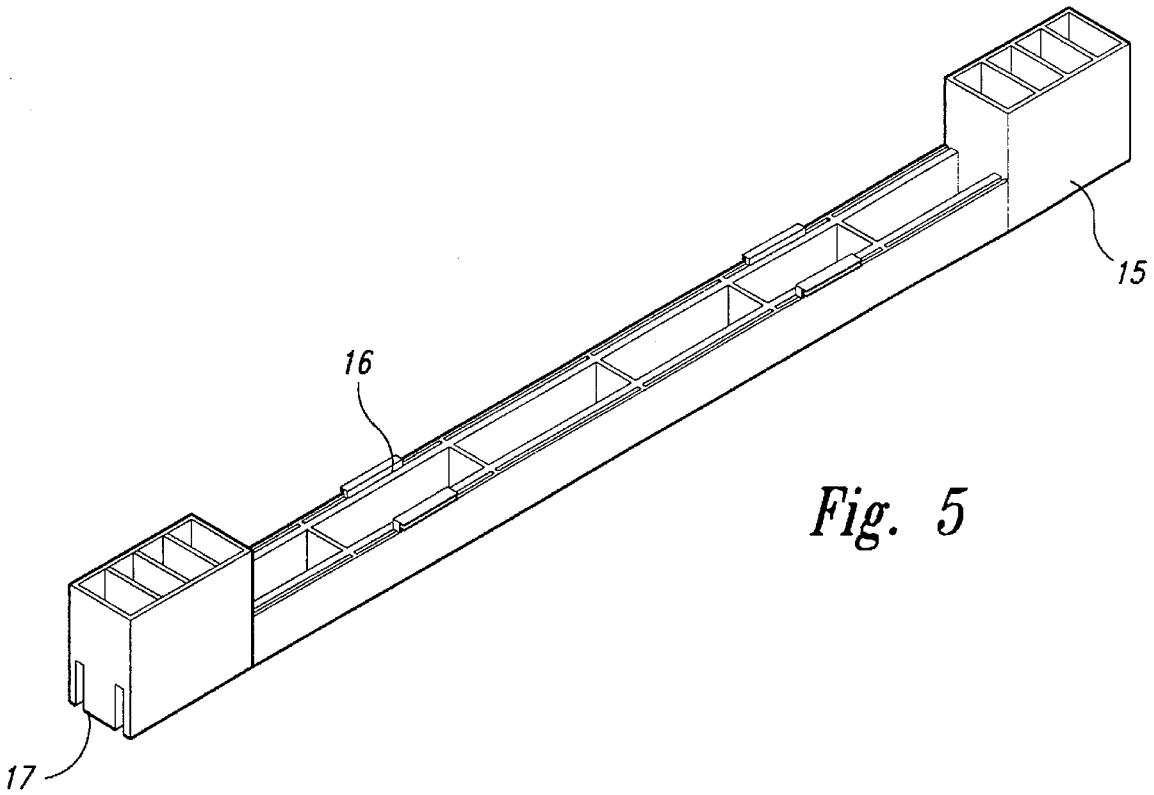
FIG. 5 is a perspective view of the component parts for the bottom of the door which provides a non-corroding, non-wrapping base which can be trimmed to the proper size.
Figure 6:
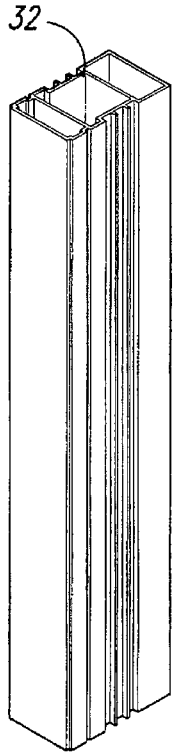
FIG. 6 is a perspective view of elongated accessory block illustrating the grooves which supports the handle and latch mechanisms in the completed door.
Figure 7:
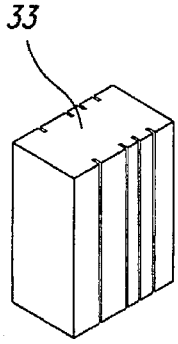
FIG. 7 is a perspective view of one of the hinge members of the door made according to this invention.
Figure 8:
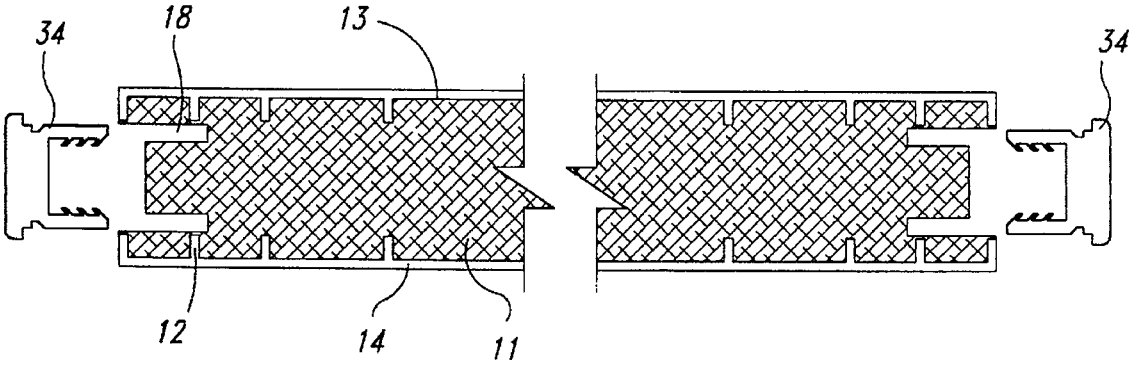
FIG. 8 is a horizontal section with the central part broken away, illustrating the use of an edge molding used after the door assembly had been trimmed to fit the door jamb where its self locking feature can be seen.
Figure 9:
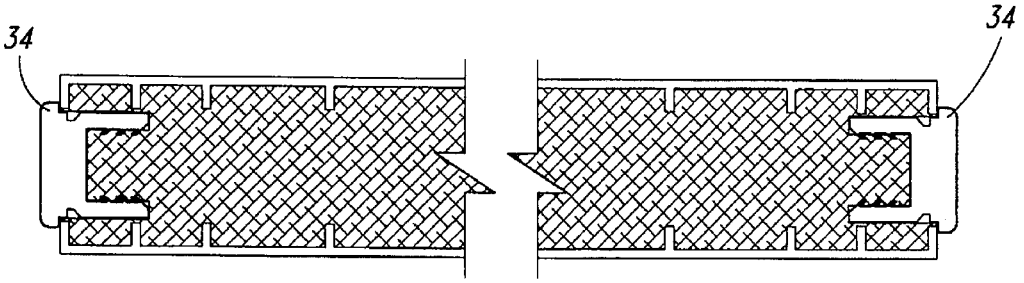
FIG. 9 is a horizontal section with the central part broken away, illustrating the use of an installed edge molding used after the door assembly had been trimmed to fit the door jamb.
Figure 10:
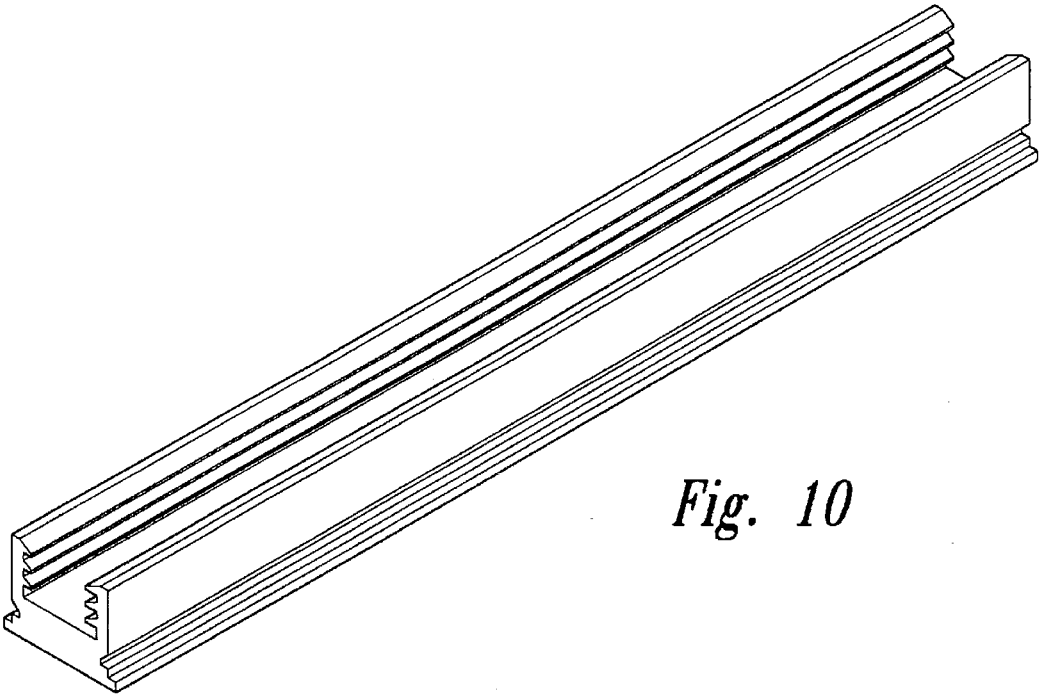
FIG. 10 is a perspective view of the edge molding used to complete the door after it has been trimmed to size.

The door according to this invention comprises two door skins 13 and 14, a bottom insert 31, an accessory block 32 for mounting handles and latches along with hinges members 33 on which to mount hinges to door. The thickness of each door skin 13, 14 is about 0.045 inches ±0.15" and will typically be embossed to simulate wood graining. These skins can be equipped with edge strips 19 and 20 at right angles to its planner surface which form the sides of the door. These strips are designed as interlocking structures as shown in FIG. 4.

The wall thickness of strip 19 in increased from the skin thickness to 0.5" and has a groove 21 formed therein so that a rib 22 on strip 20 will be received therein when the skins are assembled. Typically these strips are connected with glue. To form the rib 22 the thickness of strip 20 is increased from the skin thickness to 0.4".

When the two skins are joined, rib 22 of strip 20 will insert into the groove 21 of strip 19. Glue is applied before joining skins together to prevent glue from overflowing. Such interlocking edge structures will form a closed, hollow space between the skins. At the same time, additional wall thickness at along the edges increases the strength of the assembly.

Figure 3:
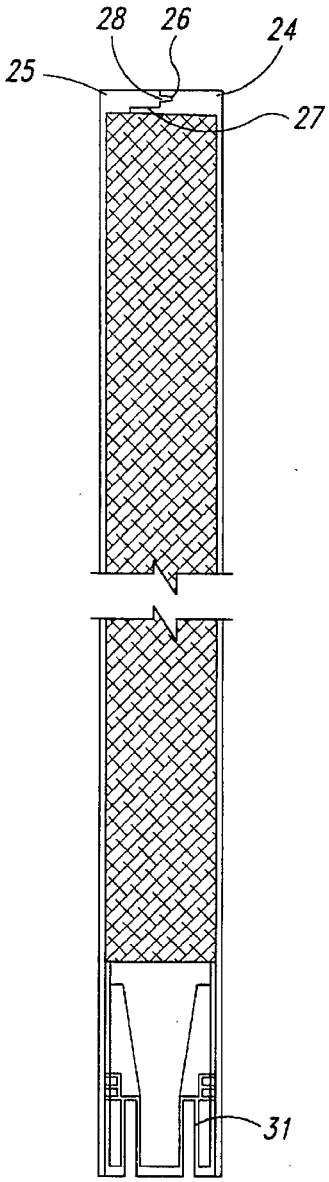
FIG. 3 is a vertical cross-section view of door assembly along lines 3—3 of FIG. 1.

The skins are designed, as illustrated in FIG. 3, to form a structure wherein they overlay each other respectively. Strips 19 and 20 are used along the sides of door and at the top a similar arrangement is used with edge strip 24 and edge strip 25. These edge strips are equipped with groove 26 in strip 24 and a rib 28 in strip 25. Also, strip 24 includes a projection 27 that slides under strip 25 to increase the interlocking arrangement. Therefore, as two skins are joined the top and sides will be closed by the strips 19 and 20 along the sides and 24 and 25 along the top.

Figure 2:
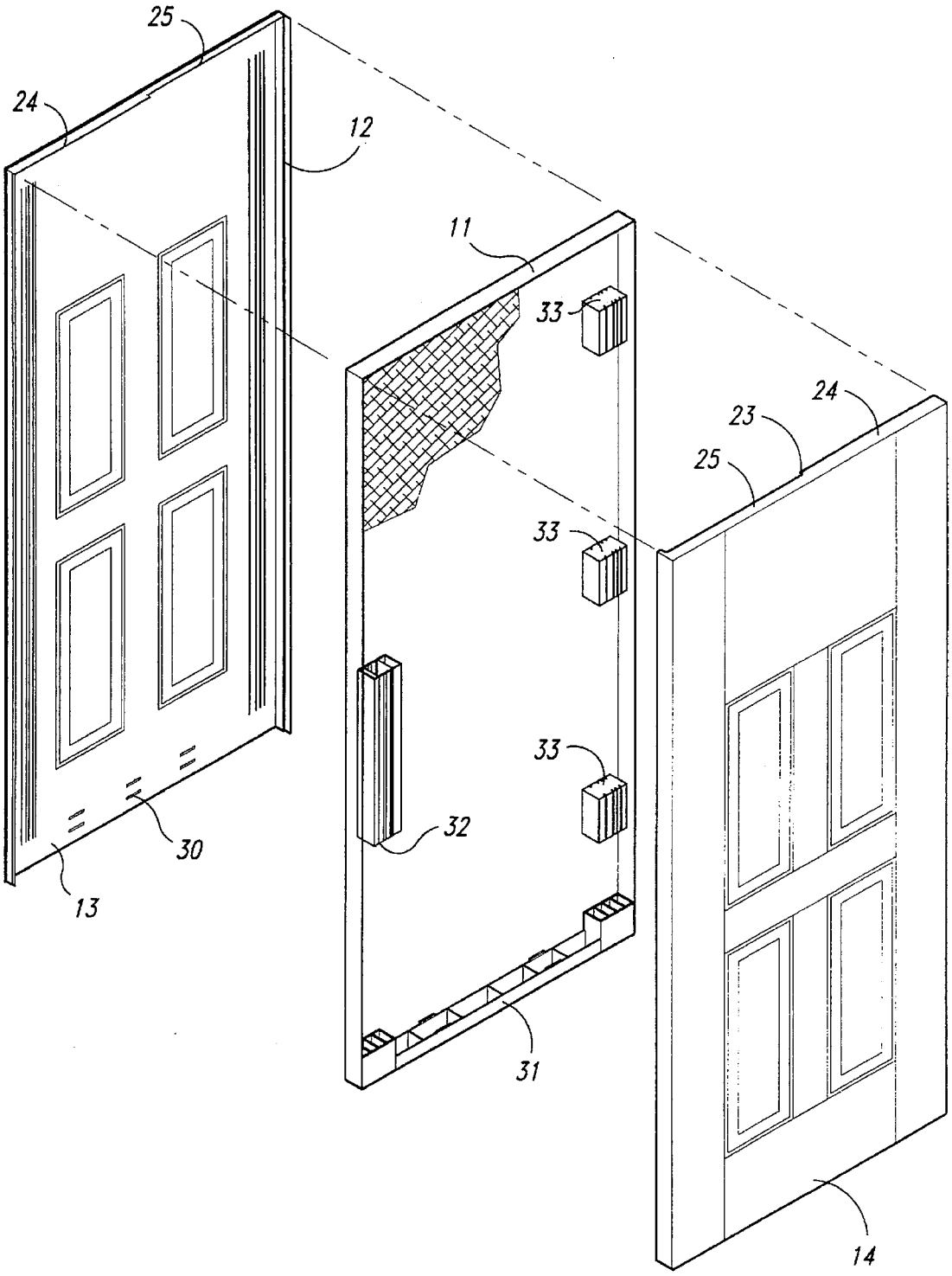
FIG. 2 is an exploded view of the door assembly of this invention shown in FIG. 1.

On the back or inside surfaces of the door skins 13, 14 are projections, that is along opposite sides, a plurality of parallel ribs 12 are provided which do not extend the full length of the panel as can be seen in FIG. 2. The bottom of the door assembly is closed by a preformed bottom insert 31, as is illustrated in FIGS. 2 and 3. It is designed to interlock with the skins. To accomplish the interlock this insert is provided with catches 16 along its top edges that are received in slots provided in the skins when the insert is pushed into the bottom of the door assembly. The catches 16 will assemble with the small ribs 30. It will prevent the bottom insert 31 slip away. This bottom insert 31 includes a pair of grooves 17 for inserting a gasket to prevent drafts from entering under the door when it is mounted in a door frame. The bottom insert 31 includes two door stoppers 15 on both sides.

During the construction of the door and before the skins are connected with one another the ribs and the grooves are coated with glue. After the skins are assembled with the accessory block 32 and the hinge members 33 and the bottom insert 31 placed in the bottom of the door a hollow chamber exists between skins, except where block and hinge members are located. As a result a hole can be drilled with upper part of the door for injecting polyurethane foam to fill the chamber and form a core 11 which completely surrounds the accessory block and the hinge members locking them in place.

This invention also has an "U" type moldings 34 that are used when the edge strips 19 and 20 are cut off to make the size of the door smaller. Molding 34 has its prongs inserted into groove 18 with glue thereon so they will stick to the foam.

The advantages of this invention are as following: First, it provides structure for interlocking the top and sides of the skins together. Second, improve the strength of the frame less door, by adding increased thickness on the strips on the sides and top. Finally, door bottom uses preformed bottom insert 31 that increases moisture resistance and limits deformation. In addition, the door bottom can be trimmed with difficulty. A major advantage is using the interlocking ribs with grooves in the accessory block and hinge member that makes the door assembly functional without a significant internal structure.

Polyurethanes have the advantage that they can be foamed by CFC-free materials and do no harm to the Ozone layer, therefore such material meet the requirements of environmental laws. Halogen-free materials are also better flame retardants.

Therefore, no cancerous substance like Dioxin and Furan are formed when conflagration occurs which is also consistent with environmental laws. Also polyurethanes have better insulating qualities and better acoustical absorption. Accordingly, door filled with polyurethane foam will function similar to doors manufactured of real wood.

Materials used for the door skins can be either thermoset or thermoplastic materials. When using thermoplastics adding of glass fiber or other material is optional. When this door is used in place of wooden doors, trees will be conserved as it is composed completely or synthetic materials. In addition, the door is better that a real wood door because of its moisture resistance and resistance to deformation plus it can be made economically. Its structure is better than the traditional composite door.

What it claim is:

1. A door assembly structure with opposing molding door panels forming its surfaces comprising:

two molded door panels of compression molded thin skins overlaid with each other to form door with a hollow core, said skins having interlocking members on their inner surfaces;

injected molded sealing edges on said door panels operable to interlock with said sealing edges of the opposing panel when said panels are overlaid with one another;

interlocking reinforced parts located respectively between said panels in the area where the handle and hinges will be attached operable to interlock with said interlocking members of said door panels; and a polyurethane core formed in place between said door panels to produce a real wood like door.

2. The assembly structure of plastics molding door panels of claim 1 wherein the injected molded sealing edge is not used at the bottom of said assembly and a door stopper is inserted and interlocked in said bottom of said assembly between said panels, said stopper having at least two grooves in its bottom edge operable to receive gaskets to make said bottom of the door airtight when installed in a door frame.

3. The assembly structure of molding door panels of claim 1 having a "U" type plastic sealing edge, wherein two sides of the assembly are trimmed, and wherein the assembly is glued in place such that said "U" type edge seals the cut sides of said assembly.

4. A compression molded door assembly comprising:

A pair of preformed rectangular skins, each having an outer surface and an inner surface;

each of said skins having two sets of a plurality of elongated ribs projecting from its inner surface disposed parallel to the longer axis of said skin with a set located adjacent to its edge on opposite sides;

an elongated accessory block with a rectangular configuration, said block having a plurality of grooves on its opposed surfaces operable to receive one set of said ribs on said skins along one edge of said skins when assembled therewith;

at least one hinge member with a rectangular configuration, said member having a plurality of grooves on its opposed surfaces operable to receive the other set of said ribs on said skins on the edge opposite to said elongated accessory block;

edge means operable to form a wall along the edges of said skins when they are assembled on said block and member; and foam means disposed between said skins that strengthens said door and lock said block and member in place.

5. The compression molded door assembly defined in claim 4 wherein three hinge members are employed.

6. A door constructed of compression molded skins comprising:

a pair of opposed molded skins, each skin having a male integral edge strip along at least one peripheral edge or a female integral edge strip along at least one peripheral edge, the integral edge strips extending perpendicular from planar surfaces of the skins;

each male integral edge strip comprising a tapered flange portion extending from its skin and terminating in a generally flat crown along with a centrally projecting rib extending from the crown;

each female integral edge strip comprising an extending flange, the flange notched so its distal end is thinner than its base with a groove formed in the base to receive the projecting rib of the male edge strip;

the skins assembled so that at least one of the male integral edge strips on one skin is received in at least one of the female integral edge strips of the other skin to form an interlocking edge for the door;

edge means closing the other edges about the other peripheral edges of the skins; and an in situ foamed polyurethane core.

7. The door as claimed in claim 6 wherein each skin has at least one male integral edge strip and at least one female integral edge strip.

8. The door as claimed in claim 6 wherein each skin has male integral edge strips and female integral edge strips with at least three edges of the door formed by such strips.

9. The door as claimed in claim 6 wherein at least one female integral edge strip has a strengthening projection located on its distal end.

10. The door as claimed in claim 6 wherein each skin has at least one male integral edge strip and at least on female integral edge strip and said door has at least one accessory block or hinge member.

11. The door as claimed in claim 6 wherein the assembled skins are fastened by glue.

* * * * *